US007581924B2

(12) United States Patent
Marini et al.

(10) Patent No.: US 7,581,924 B2
(45) Date of Patent: Sep. 1, 2009

(54) TURBINE VANES WITH AIRFOIL-PROXIMATE COOLING SEAM

(75) Inventors: Bonnie D. Marini, Oviedo, FL (US); Anthony L. Schiavo, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 389 days.

(21) Appl. No.: 11/494,178

(22) Filed: Jul. 27, 2006

(65) Prior Publication Data

US 2009/0053037 A1 Feb. 26, 2009

(51) Int. Cl.
*F01D 9/02* (2006.01)

(52) U.S. Cl. ..... 415/191; 416/193 A

(58) Field of Classification Search ..... 415/191; 416/193 A

See application file for complete search history.

(56) References Cited

U.S. PATENT DOCUMENTS

| | | | | |
|---|---|---|---|---|
| 2,013,512 | A * | 9/1935 | Birmann | 415/209.2 |
| 2,299,449 | A * | 10/1942 | Allen | 415/194 |
| 2,914,300 | A | 11/1959 | Sayre | |
| 3,583,824 | A | 6/1971 | Smuland et al. | |
| 3,873,234 | A | 3/1975 | Penny | |
| 3,986,793 | A | 10/1976 | Warner et al. | |
| 4,025,229 | A * | 5/1977 | Browning et al. | 415/191 |
| 4,026,659 | A | 5/1977 | Freeman, Jr. | |
| 4,305,697 | A | 12/1981 | Cohen et al. | |
| 4,650,399 | A | 3/1987 | Craig et al. | |
| 4,872,812 | A | 10/1989 | Hendley et al. | |
| 5,067,876 | A | 11/1991 | Moreman, III | |
| 5,083,903 | A | 1/1992 | Erdmann | |
| 5,222,865 | A | 6/1993 | Corsmeier | |
| 5,244,345 | A | 9/1993 | Curtis | |
| 5,259,728 | A | 11/1993 | Szpunar et al. | |
| 5,350,279 | A | 9/1994 | Prentice et al. | |
| 5,421,703 | A | 6/1995 | Payling | |
| 5,421,704 | A | 6/1995 | Carletti et al. | |

(Continued)

FOREIGN PATENT DOCUMENTS

| | | | |
|---|---|---|---|
| JP | 200223477 | A | 8/2002 |

(Continued)

OTHER PUBLICATIONS

Office Action dated Jan. 8, 2008 in U.S. Appl. No. 11/494,177.

(Continued)

*Primary Examiner*—Richard Edgar

(57) ABSTRACT

Aspects of the invention relate to a turbine vane in which the inner and outer platforms are located substantially entirely on either the pressure side or the suction side of the airfoil. When a plurality of such vanes are installed in the turbine, a seam is formed by the circumferential end of the inner and outer platforms and a portion of the airfoil of a neighboring vane. During engine operation, a high pressure coolant is supplied to at least one of the platforms. The coolant can leak through the seam. Because the seam is located proximate the airfoil, the coolant leakage through the seam can be productively used to cool the transition region between the vane platforms and the airfoil. In addition to such cooling benefits, aspects of the invention can result in a potential increase in engine efficiency as well as component life.

20 Claims, 7 Drawing Sheets

U.S. PATENT DOCUMENTS

| | | | | |
|---|---|---|---|---|
| 5,443,365 | A | 8/1995 | Ingling et al. | |
| 5,735,673 | A | 4/1998 | Matheny et al. | |
| 5,820,347 | A | 10/1998 | Bussonnet et al. | |
| 5,997,245 | A | 12/1999 | Tomita et al. | |
| 6,013,592 | A | 1/2000 | Merrill et al. | |
| 6,196,794 | B1 * | 3/2001 | Matsumoto | 415/191 |
| 6,283,713 | B1 | 9/2001 | Harvey et al. | |
| 6,287,511 | B1 | 9/2001 | Merrill et al. | |
| 6,390,769 | B1 | 5/2002 | Burdgick et al. | |
| 6,394,750 | B1 | 5/2002 | Hiskes | |
| 6,481,971 | B1 | 11/2002 | Forrester | |
| 6,561,764 | B1 | 5/2003 | Tiemann | |
| 6,634,863 | B1 | 10/2003 | Forrester et al. | |
| 6,641,907 | B1 | 11/2003 | Merrill et al. | |
| 6,676,783 | B1 | 1/2004 | Merrill et al. | |
| 6,821,086 | B1 | 11/2004 | Brisson et al. | |
| 6,821,087 | B2 * | 11/2004 | Matsumoto et al. | 415/191 |
| 6,830,437 | B2 | 12/2004 | Cairo et al. | |
| 6,971,845 | B2 * | 12/2005 | Weaver | 415/191 |
| 2003/0082048 | A1 | 5/2003 | Jackson et al. | |
| 2004/0001753 | A1 | 1/2004 | Tiemann | |
| 2005/0076504 | A1 | 4/2005 | Morrison et al. | |

FOREIGN PATENT DOCUMENTS

| | | | |
|---|---|---|---|
| JP | 2004084604 | A | 3/2004 |

OTHER PUBLICATIONS

Amendment dated Apr. 4, 2008 in U.S. Appl. No. 11/494,177.
Final Office Action dated May 30, 2008 in U.S. Appl. No. 11/494,177.
Amendment dated Sep. 2, 2008 in U.S. Appl. No. 11/494,177.
Notice of Allowance, Oct. 9, 2008 in U.S. Appl. No. 11/494,177.

* cited by examiner

TURBINE VANES WITH AIRFOIL-PROXIMATE COOLING SEAM

FIELD OF THE INVENTION

The invention relates in general to turbine engines and, more particularly, to turbine vanes.

BACKGROUND OF THE INVENTION

FIG. 1 shows an example of a known turbine vane 10. The vane 10 includes an airfoil 12 bounded at each of its ends by a platform 14. The airfoil 12 and the platforms 14 are commonly formed as a single piece. The airfoil 12 is usually centrally located on each of the platforms 14 such that each end of the airfoil 12 is completely surrounded by the platform 14. Each platform 14 has opposite circumferential ends 16. The region 18 in which the airfoil 12 transitions into each platform 14 is typically configured as a fillet 20. The transition region 18 is an area that experiences high thermal stresses; however, the transition region 18 has historically proved to be a challenging area to adequately cool.

A plurality of vanes 10 are arranged in an annular array in the turbine section of the engine to form a row of vanes. When installed, the circumferential end 16 of each vane platform 14 abuts a circumferential end 16 of an adjacent vane platform 14, as shown in FIG. 2. The abutting circumferential ends 16 form a seam 22. The seam 22 is located midway between each pair of neighboring airfoils 12.

During engine operation, high pressure coolant can be supplied to the platforms 14. The seam 22 presents a potential leak path for the coolant. Despite efforts to seal the seam 22, a portion of the coolant inevitably leaks through the seam 22 and enters the turbine gas path. While providing some cooling benefit to the abutting portions of the platforms 14, such leakage flow through the seam 22 is not well controlled or optimized, resulting in excessive leakage in an area that requires relatively little cooling. Thus, there is a need for a turbine vane system that can make productive use of the leakage flow through the seam between adjacent vanes.

SUMMARY TO THE INVENTION

Aspects of the invention are directed to a turbine vane. The vane includes an airfoil that has a first end region and a second end region. The airfoil also has a pressure side and a suction side. Further, the airfoil has a leading edge, a trailing edge, and an airfoil mean line that extends from the leading edge to the trailing edge.

The vane includes a first platform that is unitary with the airfoil. The first platform transitions into the airfoil in the first end region. The first platform is located substantially entirely on either the pressure side or the suction side of the airfoil. The first platform extends substantially circumferentially from the airfoil to a circumferential side. The circumferential side is contoured to engage another airfoil. For example, the circumferential side can be contoured to substantially matingly engage the outer peripheral surface of another airfoil.

In one embodiment, the first platform can be located substantially entirely on the pressure side of the airfoil. In such case, the circumferential side can be contoured to engage the suction side of another airfoil. Alternatively, the first platform can be located substantially entirely on the suction side of the airfoil, and the circumferential side of the first platform can be contoured to engage the pressure side of another airfoil.

The turbine vane can further include a second platform unitary with the airfoil. The second platform can transition into the airfoil in the second end region. The second platform can be located substantially entirely on either the pressure side or the suction side of the airfoil. In one embodiment, the first and second platforms can be located on the same side of the airfoil. From the airfoil, the second platform can extend substantially circumferentially to a circumferential side that is contoured to engage another airfoil.

In one embodiment, the first platform does not substantially extend beyond a boundary defined by an imaginary extrapolation of the airfoil mean line beyond the airfoil. In another embodiment, the first platform does not substantially extend beyond a boundary defined by an imaginary axial line extending from the leading edge of the airfoil and an imaginary axial line extending from the trailing edge of the airfoil.

The outer peripheral surface of the airfoil on the opposite one of the pressure side and the suction side of the airfoil from the first platform can be exposed in the first end region. Alternatively, the first platform can further include a platform lip that extends in the first end region about the opposite one of the pressure side and the suction side of the airfoil from the first platform.

Aspects of the invention also concern a turbine vane system. The system includes a first turbine vane and a second turbine vane. The first turbine vane includes a first airfoil with a unitary first outer platform. The first airfoil has an outer region, an inner end region, an outer peripheral surface, a pressure side, a suction side, a leading edge, a trailing edge, and an airfoil mean line that extends from the leading edge to the trailing edge. The first outer platform transitions into the first airfoil in the outer end region. The first outer platform is located substantially entirely on either the pressure side or the suction side of the first airfoil.

The second turbine vane includes a second airfoil with a unitary second outer platform. The second airfoil has an outer end region, an inner end region, a pressure side, a suction side, a leading edge, a trailing edge, and an airfoil mean line that extends from the leading edge to the trailing edge. The second outer platform transitions into the second airfoil in the outer end region. The second outer platform is located substantially entirely on the same one of the pressure side and the suction side of the second airfoil as the first outer platform relative to the first airfoil of the first turbine vane. The second outer platform extends substantially circumferentially from the second airfoil to a circumferential side, which is contoured to engage at least a portion of the side of the first airfoil opposite the first outer platform. For instance, the circumferential side can be contoured to substantially matingly engage at least a portion of the outer peripheral surface of the first airfoil in the outer end region.

The first vane is positioned substantially adjacent the second vane such that the outer end region of the first airfoil is substantially cooperatively enclosed by the first outer platform and the circumferential end of the second outer platform. A seam is formed between the substantially adjacent portions of the first and second vanes. The system can further include a seal operatively positioned along at least a portion of the seam. The seam includes a cooling gap that extends proximate the side of the first airfoil that is opposite the first outer platform. The system also can include a coolant supplied to the outer platform. At least a portion of the coolant can flow through the cooling gap such that the interface between the circumferential end of the second outer platform and the first airfoil can be cooled.

The first outer platform can be located substantially entirely on the pressure side of the first airfoil, and the circumferential side of the second outer platform can be contoured to engage the suction side of the first airfoil. Alternatively, the first outer platform can be located substantially entirely on the suction side of the first airfoil, and the circumferential side of the second outer platform can be contoured to engage the pressure side of the first airfoil.

The first outer platform can include a platform lip, which can extend in the outer end region of the airfoil and about the opposite one of the pressure side and the suction side of the airfoil from the first platform. By providing such a lip, the cooling gap can be formed in part between the platform lip of the first outer platform and the circumferential end of the second outer platform. In one embodiment, the outer peripheral surface of the first airfoil on the opposite one of the pressure side and the suction side of the first airfoil from the first outer platform can be exposed in the outer end region. As a result, the cooling gap can be formed in part between the outer peripheral surface of the first airfoil and the circumferential end of the second outer platform.

In one embodiment, the first outer platform does not extend substantially beyond a boundary defined by an imaginary extrapolation of the mean line beyond the first airfoil. In another embodiment, the first outer platform does not extend substantially beyond a boundary defined by an imaginary axial line extending from the leading edge of the first airfoil and an imaginary axial line extending from the trailing edge of the first airfoil.

DETAILED DESCRIPTION OF EMBODIMENTS OF THE INVENTION

Aspects of the present invention are directed to a vane system that can take advantage of the platform seam coolant leakage flow, which would otherwise be wasted in prior turbine vane systems. Aspects of the present invention involve a relocation of the seam to a location proximate the airfoil so that leakage flow therethrough can be used to cool the transition region between the airfoil and the platforms. Embodiments of the invention will be explained in the context of several possible vane configurations, but the detailed description is intended only as exemplary. Embodiments of the invention are shown in FIGS. 3-8, but the present invention is not limited to the illustrated structure or application.

Figure 1:
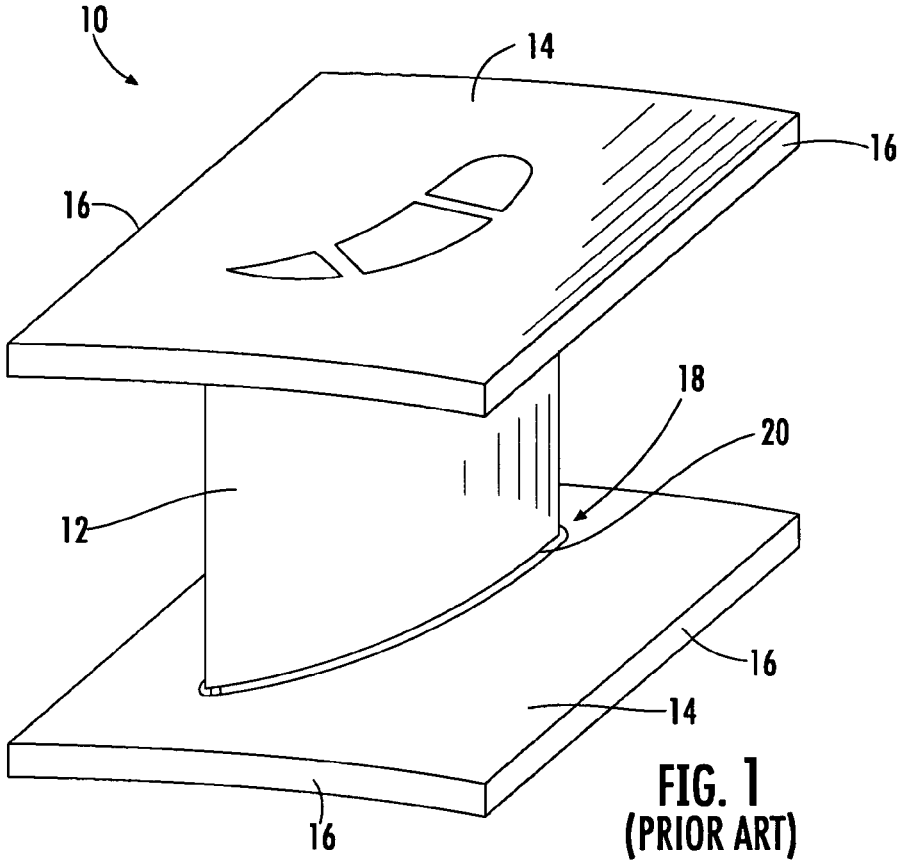
FIG. 1 (PRIOR ART)
FIG. 1 is an isometric view of a known turbine vane.
Figure 2:
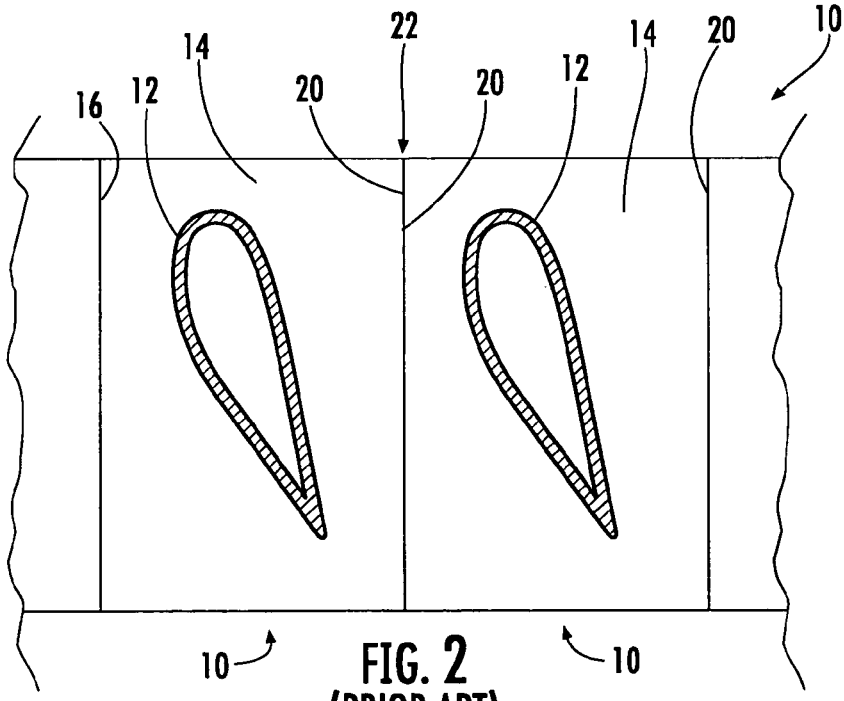
FIG. 2 (PRIOR ART)
FIG. 2 is a cross-sectional view of a pair of adjacent turbine vanes in a known turbine engine.
Figure 3:
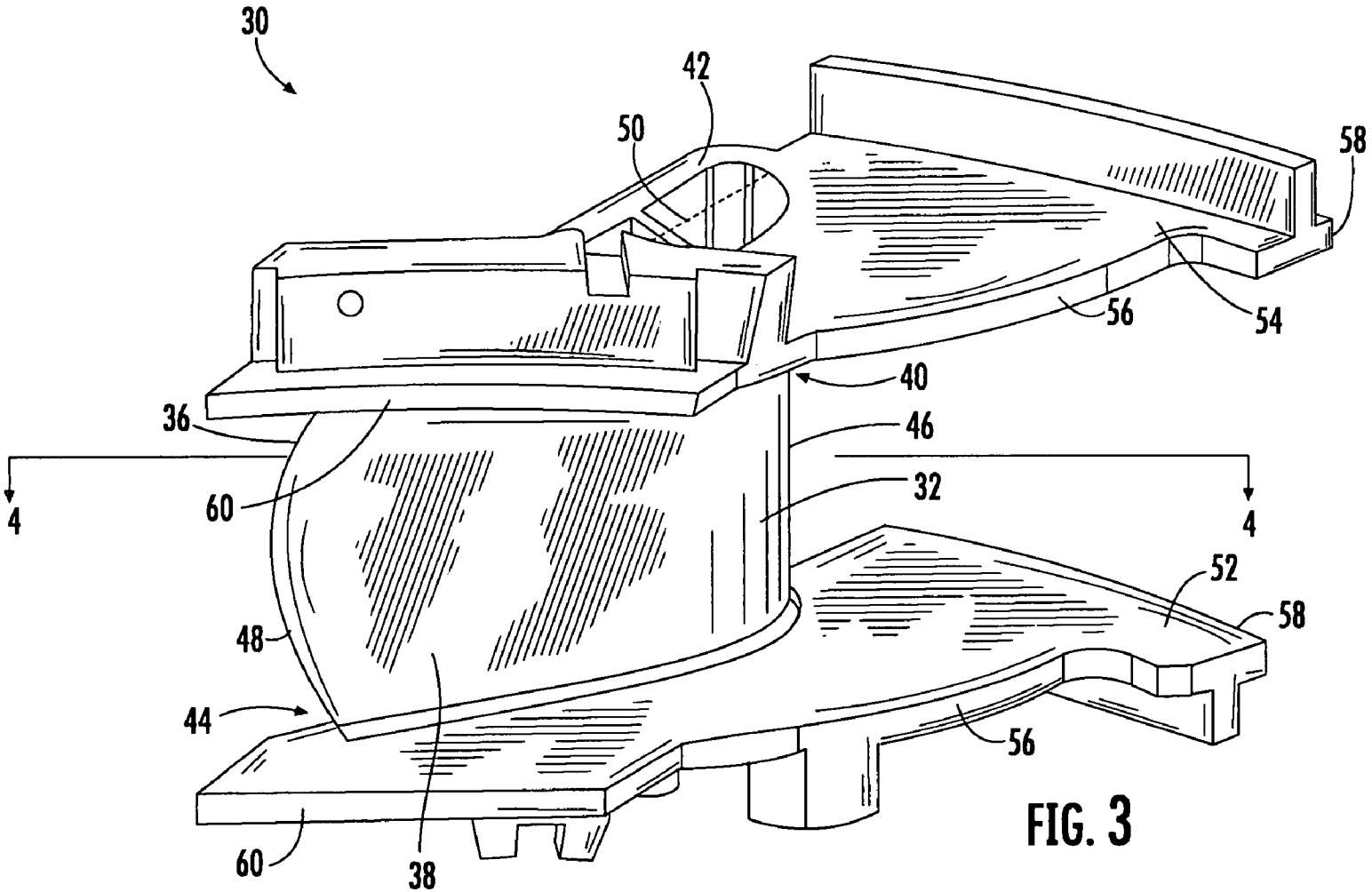
FIG. 3 is an isometric view of a turbine vane according to aspects of the invention.

FIG. 3 shows a turbine vane 30 according to aspects of the invention. The turbine vane 30 includes an elongated airfoil 32. The airfoil 32 has an outer peripheral surface 34 that is generally divided between a pressure side 36 and a suction side 38. The airfoil 32 can have an outer end region 40 that includes an outer end 42. Further, the airfoil 32 can have an inner end region 44 that includes an inner end 45 (see FIG. 8). The terms "inner" and "outer," as used herein, are intended to mean relative to the axis of the turbine when the vane 30 is installed in its operational position. The airfoil 32 can have a leading edge 46, a trailing edge 48 and a mean line 50. The mean line 50 is an imaginary line extending from the leading edge 46 to the trailing edge 48 and is equidistant from the pressure and suction sides 36, 38 of the airfoil 32.

The turbine vane 10 can also include an inner platform 52 and an outer platform 54. The inner and outer platforms 52, 54 are formed with the airfoil 32 so as to be a single piece, that is, as a unitary construction. The inner platform 52 can transition into the airfoil 32 at the inner end region 44 of the airfoil 32. Similarly, the outer platform 54 can transition into the airfoil 32 at the outer end region 40.

Figure 4:
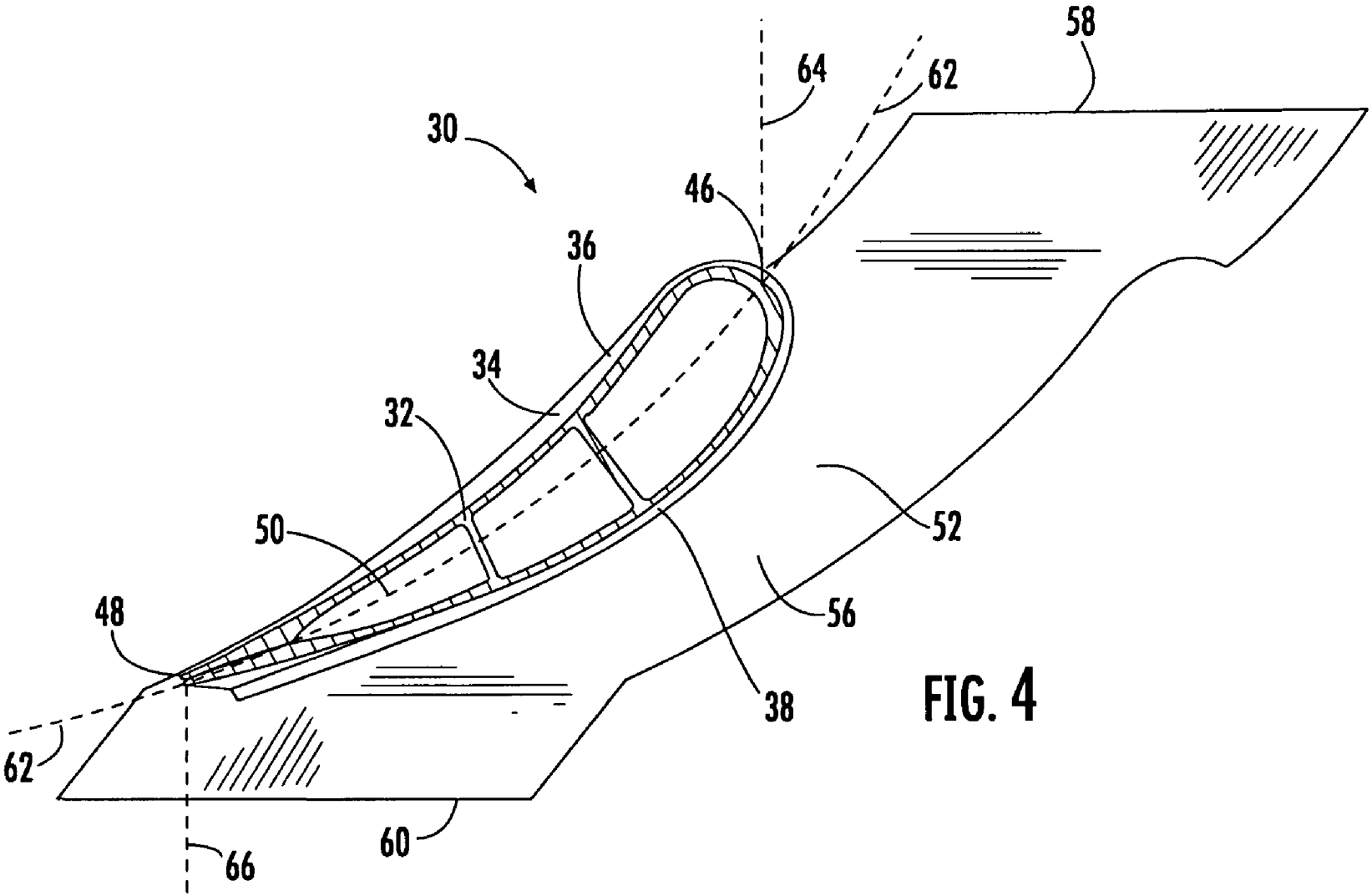
FIG. 4 is a cross-sectional view of a turbine vane configured according to aspects of the invention, viewed from line 4-4 in FIG. 3, wherein the platform is formed on the suction side of the airfoil.

According to aspects of the invention, one or both of the inner and outer platforms 52, 54 can be located substantially entirely on one of the pressure side 36 or the suction side 38 of the airfoil 32. FIGS. 3 and 4 show an embodiment of a vane 10 in accordance with aspects of the invention in which the inner platform 52 and the outer platform 54 are formed substantially entirely on the suction side 38 of the airfoil 32. Because there is no platform on the pressure side 36 of the airfoil 32, the outer peripheral surface 34 of the airfoil 32 can be exposed on the pressure side 36 in each of the end regions 40, 44.

From the suction side 38 the airfoil 32, each platform 52, 54 can extend circumferentially to a circumferential side 56. At least a portion of the circumferential side 56 can be contoured for engagement with a portion of a neighboring airfoil. In the embodiment shown in FIGS. 3 and 4, the circumferential side 56 can be contoured for engagement with at least a portion of the pressure side of a neighboring airfoil. Preferably, the circumferential side 56 is contoured for substantially mating engagement with at least a portion of the pressure side of a neighboring airfoil.

The platforms 52, 54 can also extend from the airfoil 32 to an axial forward side 58 and an axial rearward side 60. The airfoil 32 can be located substantially centrally between the axial forward side 58 and the axial rearward side 60 of each platform. The terms "axial," "circumferential" and variants thereof are intended to mean relative to the axis of the turbine when the vane 30 is installed in its operational position. The configuration of the inner platform 52 may or may not be substantially identical to the configuration of the outer platform 54.

Generally, the inner and outer platforms 52, 54 are formed on the suction side 38 of the airfoil 32 so as not to extend beyond the leading edge 46 and the trailing edge 48 of the airfoil 32. In one embodiment, the inner and outer platforms 52, 54 can be located substantially entirely on the suction side 38 of the airfoil 32 such that a substantial majority of each platform 52, 54 does not extend beyond a boundary defined by an imaginary extrapolation 62 of the airfoil mean line 50 beyond the outer peripheral surface 34 of the airfoil 32. Alternatively, the inner and outer platforms 52, 54 can be located substantially entirely on the suction side 38 of the airfoil 32 such that a substantial majority of each platform does not substantially extend beyond a boundary defined by an imaginary axial line 64 extending from the leading edge 46 of the airfoil 32 and an imaginary axial line 66 extending from the trailing edge 48 of the airfoil 32. However, as shown in FIG. 4, portions of one or both platforms 52, 54 can cross each of these boundaries.

Figure 5:
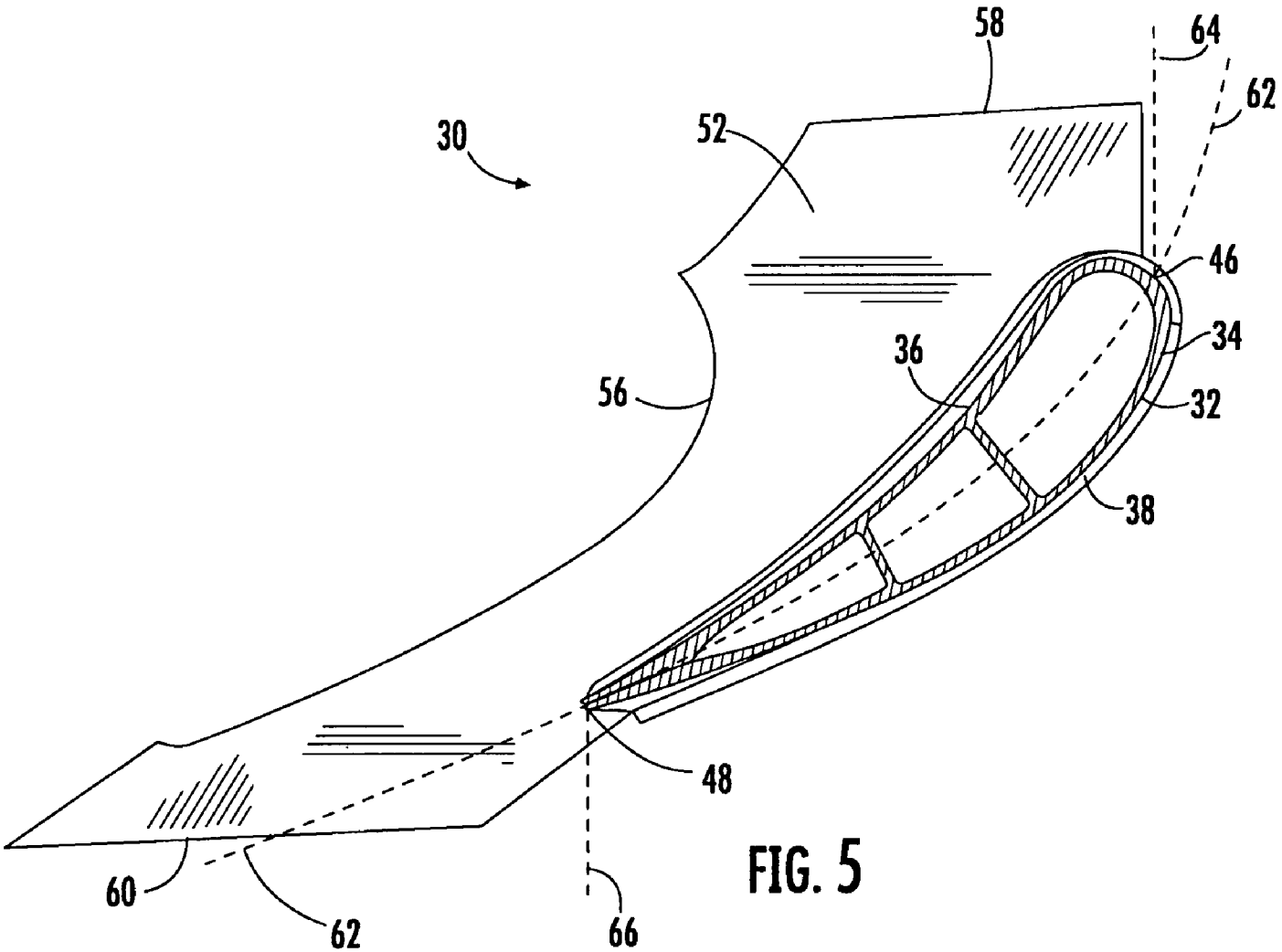
FIG. 5 is a cross-sectional view of an alternative turbine vane configured according to aspects of the invention, wherein the platform is formed on the pressure side of the airfoil.

Aspects of the invention are not limited to embodiments in which the platforms 52, 54 are formed on the suction side 38 of the airfoil 32. For instance, as shown in FIG. 5, the platforms 52, 54 can be formed on the pressure side 36 of the airfoil 32 as well. In such case, the suction side 38 of the airfoil 32 can be exposed in each of the end regions 40, 44. The above discussion with respect to embodiments of the invention shown in FIGS. 3 and 4 can have equal application to the platform configuration shown in FIG. 5. It should be noted that the circumferential sides 56 of the platforms 52, 54 can be adapted to receive suction side of a neighboring airfoil.

Figure 7:
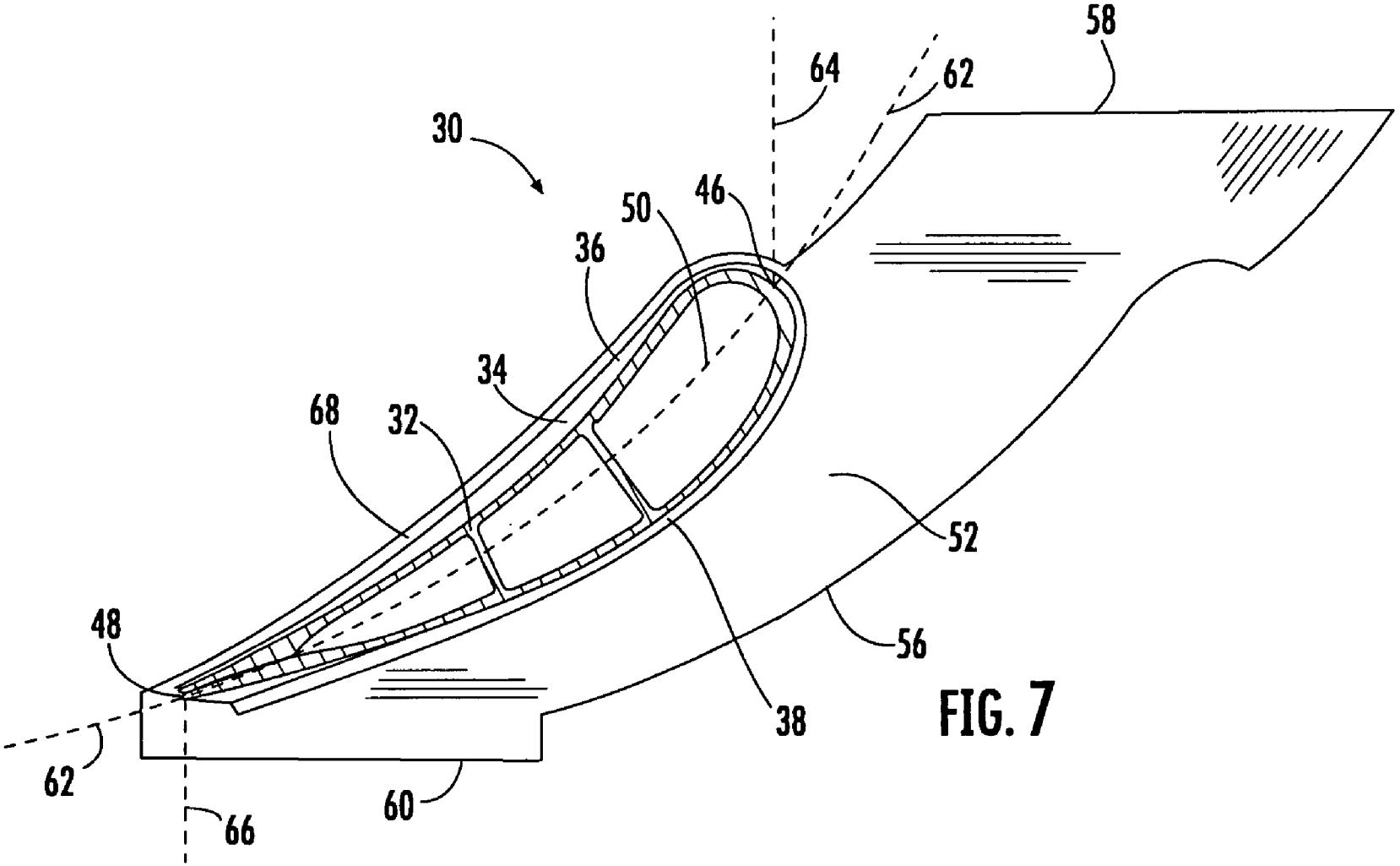
FIG. 7 is a cross-sectional view of an alternative turbine vane configuration according to aspects of the invention, wherein the platform is formed on the suction side of the airfoil and the pressure side of the airfoil includes a platform lip.
Figure 8:
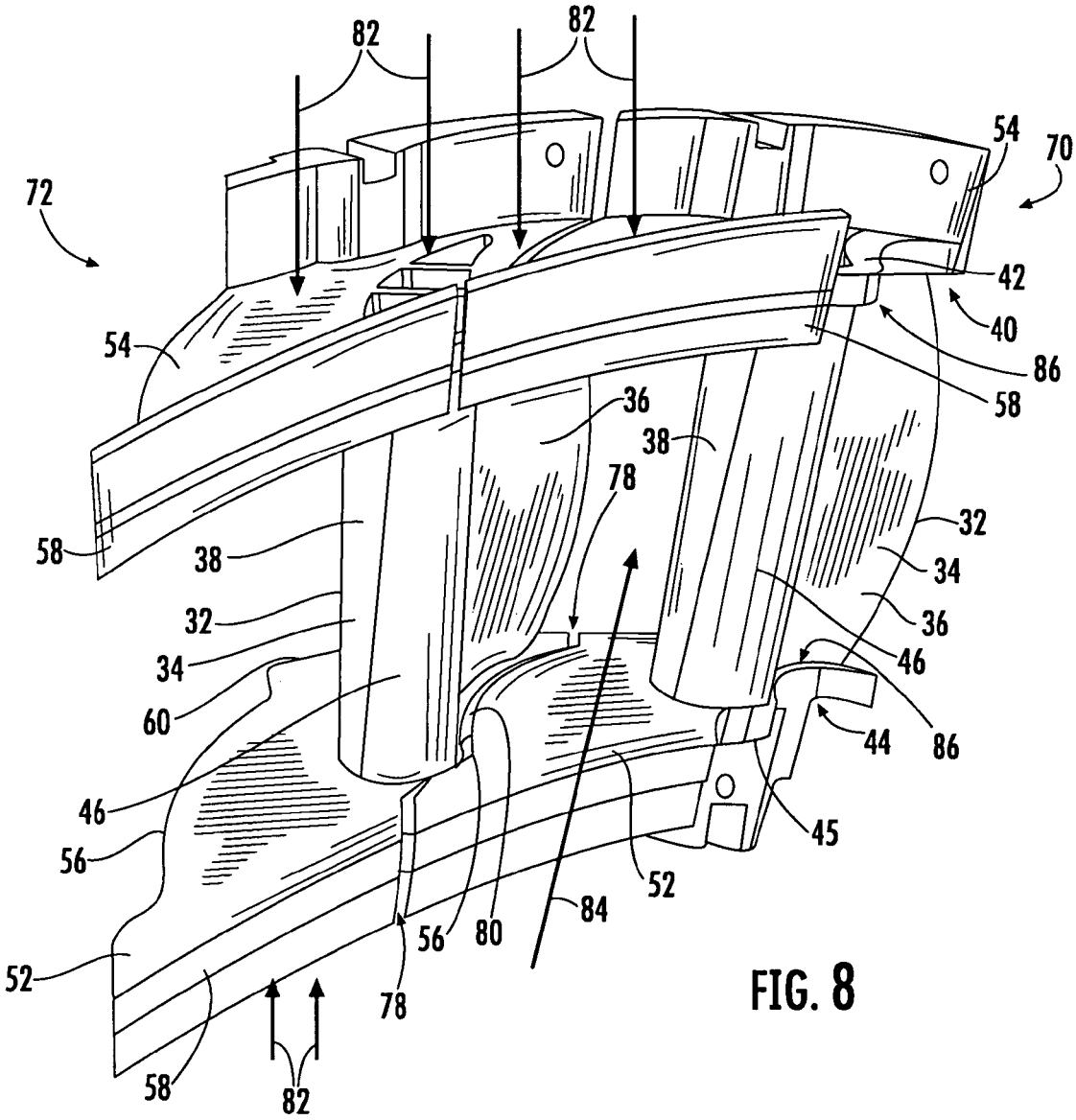
FIG. 8 is an isometric view of a pair of adjacent turbine vanes configured in accordance with aspects of the invention.

Further, aspects of the invention are not limited to embodiments in which the side of the airfoil opposite the unitary platform is exposed in the end region. For instance, FIG. 7 shows an embodiment in which the platform 52 is formed on the suction side 38 of the airfoil 32. The platform 52 can continue as a small lip 68 extending along the pressure side 36 of the airfoil 32. The platform lip 68 can generally follow the contour of the outer peripheral surface 34 of the airfoil 32. The platform lip 68 remains sufficiently close to the airfoil 32 in order to gain any cooling benefit in accordance with aspects of the invention, as will be explained in more detail later. In one embodiment, the platform lip 68 extends about 0.25 inches from the airfoil 32. However, aspects of the invention are not limited to any particular width of the platform lip 68.

Figure 6:
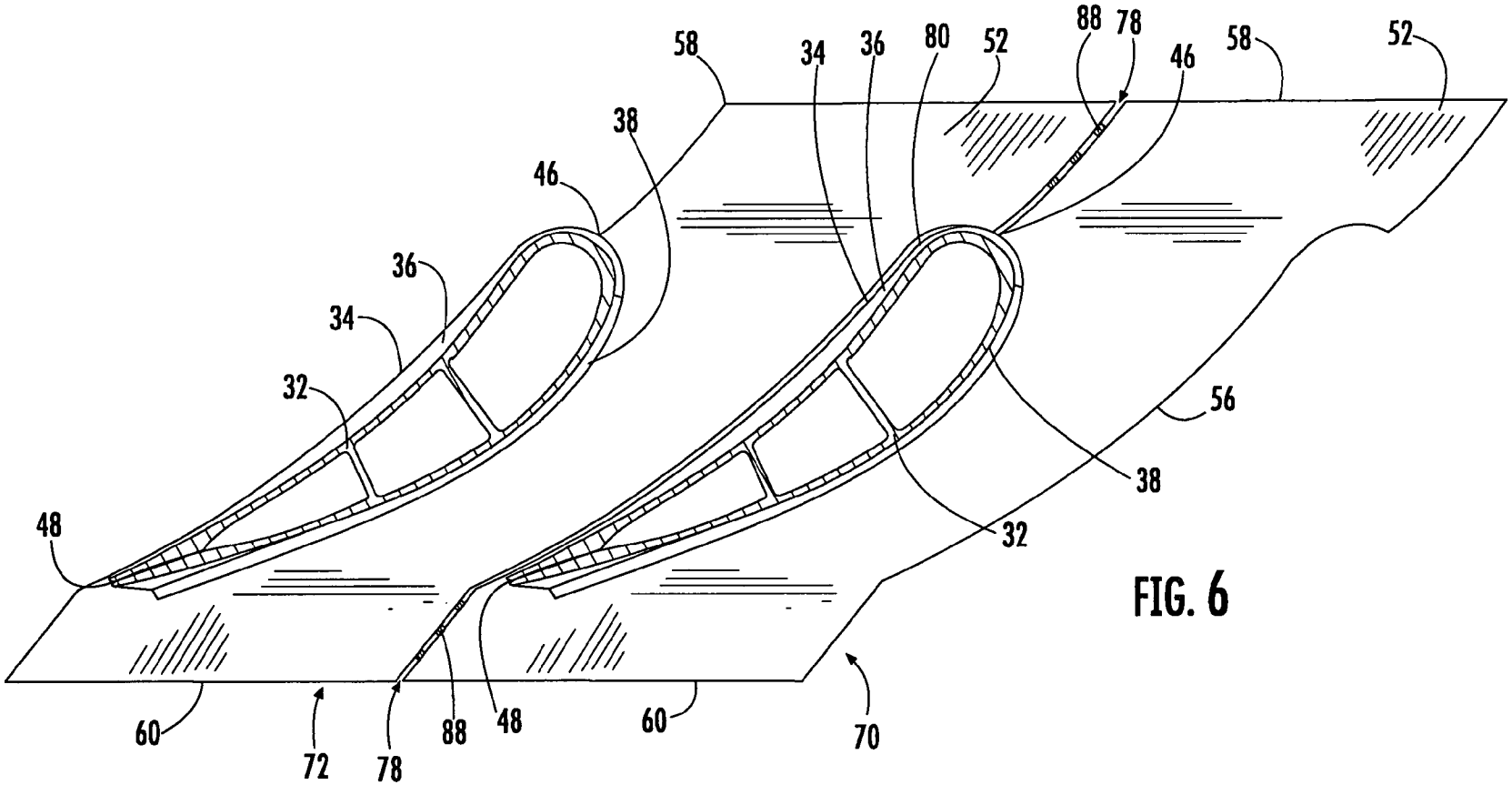
FIG. 6 is a cross-sectional view of a pair of adjacent turbine vanes configured in accordance with aspects of the invention.

In any given row of vanes, one or more of the vanes can be constructed in accordance with aspects of the invention. The vanes can be connected to a vane carrier (not shown) or other stationary support structure (not shown) in the turbine section. FIG. 6 shows two adjacent vanes configured in accordance with aspects of the invention. A first vane 70 and a second vane 72 can be brought together so that the unitary platform 52 of the first vane 70 and the unitary suction side platform 52 of the adjacent second vane 72 cooperatively enclose the airfoil 32 of the first vane 70. As shown, a seam 78 is formed between the abutting portions of the first and second vanes 70, 72. In contrast to prior vane systems, the seam 78 is not located in a central region between two neighboring airfoils. Rather, the seam 78 is extends about the pressure side 36 of the airfoil 32. The seam 78 can extend away from the leading edge 46 of the airfoil 32 in a generally axially forward direction. Likewise, the seam 78 can extend away from the trailing edge 48 of the airfoil 32 in a generally axially rearward direction. As a result, a cooling gap 80 is formed about the pressure side 36 of the airfoil 32.

It should be noted that the circumferential side 56 of the platform 52 associated with the second vane 72 can engage the airfoil 32 of the first vane 70 in any of a number of ways. For instance, the circumferential end 56 can engage the outer peripheral surface 34 of the airfoil 32 in the end region 40 of the pressure side 36 of the vane 32. Alternatively or in addition, at least a portion of the circumferential end 56 can extend under the platform 52 associated with the first vane 70 so as to engage at least a portion of the inner end (not shown) of the first airfoil 32. For a vane 10 configured as shown in FIG. 7, the circumferential end 56 can engage at least a portion of the platform lip 68. It will be understood that these are just a few examples of the various ways in which the circumferential ends of the platform can engage the airfoil. Though the above discussion concerned the engagement between the inner platform 52 and the inner end region 44 of the airfoil 32, it will be understood that the discussion is equally applicable to the interactions at the outer end regions 40 of the first and second vanes 70, 72. Further, the engagement between the inner platform and the inner end region of the airfoil may or may not be substantially identical to the engagement between the outer platform and the outer end region of the airfoil.

During engine operation, a high pressure coolant 82, such as air, can be supplied to the platforms 52, 54. A portion of the coolant 82 can leak through the cooling gap 80 and enter the turbine gas path 84. Because the seam 78 is located proximate the airfoil 32, the coolant leakage can cool the transition region 86 between the airfoil 32 and the platforms 52, 54, particularly when the cooling gap 80 is formed in part by the airfoil 32. Such cooling benefits can also be enjoyed when the vane 10 includes a platform lip 68, as shown in FIG. 7, so long as the platform lip 68 remains sufficiently close to the airfoil.

To further focus the leakage toward the airfoil, one or more seals 88 can be operatively positioned along those portions of the seam 78 formed by the abutting portions of the platforms 52, 54 of the first vane 70 and the platforms 52, 54 of the second vane 72. The seals 88 can be any suitable seal, such as flat plate seals, riffle seals, etc. Thus, it will be appreciated that the seals 88 can be used to direct the leakage flow through those portions of the seam 78 that are proximate the airfoil 32.

Aside from the cooling effect, aspects of the invention can result in a number of additional benefits. For example, aspects of the invention can result in a potential increase in engine efficiency as well as component life. Further, the unitary platform and airfoil can facilitate assembly and can reduce the number of unique pieces to install. Further, by providing the platform on one side, less sealing is needed and a more controlled leakage flow can be achieved.

The foregoing description is provided in the context of various embodiments of a turbine vane in accordance with aspects of the invention. It will be understood that aspects of the invention can be applied to any of a number of vane configurations. For instance, a vane can include multiple airfoils extending between the inner and outer platform. Aspects of the invention can be applied to such vanes, though not all of the airfoils will benefit from the leakage flow through the seam. Thus, it will of course be understood that the invention is not limited to the specific details described herein, which are given by way of example only, and that various modifications and alterations are possible within the scope of the invention as defined in the following claims.

What is claimed is:

1. A turbine vane system comprising:

a first turbine vane including a first airfoil with a unitary first outer platform, the first airfoil having an outer end region, an inner end region, an outer peripheral surface, a pressure side, a suction side, a leading edge, a trailing edge, and an airfoil mean line extending from the leading edge to the trailing edge, wherein the first outer platform transitions into the first airfoil in the outer end region, wherein the first outer platform is located substantially entirely on one of the pressure side and the suction side of the first airfoil; and a second turbine vane including a second airfoil with a unitary second outer platform, the second airfoil having an outer end region, an inner end region, a pressure side, a suction side, a leading edge, a trailing edge, and an airfoil mean line extending from the leading edge to the trailing edge, wherein the second outer platform transitions into the second airfoil in the outer end region, wherein the second outer platform is located substantially entirely on the same one of the pressure side and the suction side of the second airfoil as the first outer platform of the first turbine vane, the second outer platform extending substantially circumferentially from the second airfoil to a circumferential side that is contoured to engage at least a portion of the side of the first airfoil opposite the first outer platform, the first vane being positioned substantially adjacent the second vane such that the outer end region of the first airfoil is substantially cooperatively enclosed by the first outer platform and the circumferential end of the second outer platform, wherein a seam is formed between the substantially adjacent portions of the first and second vanes, the seam including a cooling gap extending proximate the side of the first airfoil opposite the first outer platform.

2. The turbine vane of claim 1 wherein the first outer platform is located substantially entirely on the pressure side of the first airfoil, and wherein the circumferential side of the second outer platform is contoured to engage the suction side of the first airfoil.

3. The turbine vane of claim 1 wherein the first outer platform is located substantially entirely on the suction side of the first airfoil, and wherein the circumferential side of the second outer platform is contoured to engage the pressure side of the first airfoil.

4. The turbine vane of claim 1 wherein the circumferential side is contoured to substantially matingly engage at least a portion of the outer peripheral surface of the first airfoil in the outer end region.

5. The turbine vane of claim 1 wherein the first outer platform does not extend substantially beyond a boundary defined by an imaginary extrapolation of the mean line beyond the first airfoil.

6. The turbine vane of claim 1 wherein the first outer platform does not extend substantially beyond a boundary defined by an imaginary axial line extending from the leading edge of the first airfoil and an imaginary axial line extending from the trailing edge of the first airfoil.

7. The turbine vane system of claim 1 further including a coolant supplied to the outer platform, wherein at least a portion of the coolant flows through the cooling gap, whereby the interface between the circumferential end of the second outer platform and the first airfoil is cooled.

8. The turbine vane system of claim 1 further including a seal operatively positioned along at least a portion of the seam.

9. The turbine vane of claim 1 wherein the first outer platform further includes a platform lip that extends in the outer end region about the opposite one of the pressure side and the suction side of the airfoil from the first platform, whereby the cooling gap is formed in part between the platform lip of the first outer platform and the circumferential end of the second outer platform.

10. The turbine vane of claim 1 wherein the outer peripheral surface of the first airfoil on the opposite one of the pressure side and the suction side of the first airfoil from the first outer platform is exposed in the outer end region, whereby the cooling gap is formed in part between the outer peripheral surface of the first airfoil and the circumferential end of the second outer platform.

11. The turbine vane of claim 1 wherein the first turbine vane further includes a first inner platform unitary with the first airfoil, wherein the first inner platform transitions into the first airfoil in the inner end region, wherein the first inner platform is located substantially entirely on one of the pressure side and the suction side of the first airfoil, wherein the second turbine vane includes a second inner platform unitary with the second airfoil, wherein the second inner platform transitions into the second airfoil in the inner end region, wherein the second inner platform is located substantially entirely on the same one of the pressure side and the suction side of the second airfoil as the first inner platform of the first turbine vane, the second inner platform extending substantially circumferentially from the second airfoil to a circumferential side that is contoured to engage at least a portion of the side of the first airfoil opposite the first outer platform, and wherein the inner end region of the first airfoil is substantially cooperatively enclosed by the first inner platform and the circumferential end of the second inner platform, wherein a seam is formed between the substantially adjacent portions of the first and second vanes, the seam including a cooling gap extending proximate the side of the first airfoil opposite the first inner platform.

12. The turbine vane of claim 11 wherein the first inner platform and the first outer platform are located on the same one of the pressure side and the suction side of the first airfoil, and wherein the second inner platform and the second outer platform are located on the same one of the pressure side and the suction side of the second airfoil.

13. A turbine vane system comprising:

a first turbine vane including a first airfoil with a unitary first inner platform, the first airfoil having an outer end region, an inner end region, an outer peripheral surface, a pressure side, a suction side, a leading edge, and a trailing edge, wherein the first inner platform transitions into the first airfoil in the inner end region, wherein the first inner platform is located substantially entirely on one of the pressure side and the suction side of the first airfoil; and a second turbine vane including a second airfoil with a unitary second inner platform, the second airfoil having an outer end region, an inner end region, a pressure side, a suction side, a leading edge, and a trailing edge, wherein the second inner platform transitions into the second airfoil in the inner end region, wherein the second inner platform is located substantially entirely on the same one of the pressure side and the suction side of the second airfoil as the first inner platform of the first turbine vane, the second inner platform extending substantially circumferentially from the second airfoil to a circumferential side that is contoured to engage at least a portion of the side of the first airfoil opposite the first inner platform, the first vane being positioned substantially adjacent the second vane such that the inner end region of the first airfoil is substantially cooperatively enclosed by the first inner platform and the circumferential end of the second inner platform, wherein a seam is formed between the substantially adjacent portions of the first and second vanes, the seam including a cooling gap extending proximate the side of the first airfoil opposite the first inner platform.

14. A method of cooling a portion of an airfoil comprising:

providing a turbine engine, the turbine engine including a first turbine vane and a second turbine vane, the first turbine vane including a first airfoil with a unitary first platform, the first airfoil having an outer end region, an inner end region, an outer peripheral surface, a pressure side, a suction side, a leading edge, and a trailing edge, wherein the first platform transitions into the first airfoil in one of the inner end region and the outer end region, wherein the first platform is located substantially entirely on one of the pressure side and the suction side of the first airfoil; and the second turbine vane including a second airfoil with a unitary second platform, the second airfoil having an outer end region, an inner end region, a pressure side, a suction side, a leading edge, and a trailing edge, wherein the second platform transitions into the second airfoil in one of the outer end region and the inner end region, wherein the second platform is located substantially entirely on the same one of the pressure side and the suction side of the second airfoil as the first platform of the first turbine vane, the second platform extending substantially circumferentially from the second airfoil to a circumferential side that is contoured to engage at least a portion of the side of the first airfoil opposite the first platform, the first vane being positioned substantially adjacent the second vane such that one of the outer end region and the inner end region of the first airfoil is substantially cooperatively enclosed by the first platform and the circumferential end of the second platform, wherein a seam is formed between the substantially adjacent portions of the first and second vanes, the seam including a cooling gap extending proximate the side of the first airfoil opposite the first platform; and supplying a coolant to the first and second platforms such that a portion of the coolant leaks through the cooling gap, whereby a portion of the first airfoil proximate the cooling gap is cooled by the leaking coolant.

15. The method of claim 14 further including the step of directing the leakage toward the first airfoil.

16. The method of claim 15 wherein the directing step includes operatively positioning at least one seal along at least a portion of the cooling seam.

17. The method of claim 14 wherein the first platform is located substantially entirely on the pressure side of the first airfoil, and wherein the circumferential side of the second platform is contoured to engage the suction side of the first airfoil.

18. The method of claim 14 wherein the first platform is located substantially entirely on the suction side of the first airfoil, and wherein the circumferential side of the second platform is contoured to engage the pressure side of the first airfoil.

19. The method of claim 14 wherein the circumferential side of the second platform is contoured to substantially matingly engage at least a portion of the outer peripheral surface of the first airfoil in one of the first and second end regions.

20. The method of claim 14 wherein the first platform further includes a platform lip that extends about the opposite one of the pressure side and the suction side of the airfoil from the first platform, whereby the cooling gap is formed in part between the platform lip of the first platform and the circumferential end of the second platform.

* * * * *